United States Patent [19]

Matsutani et al.

[11] Patent Number: 4,543,794

[45] Date of Patent: Oct. 1, 1985

[54] SUPERCONDUCTING MAGNET DEVICE

[75] Inventors: Kinya Matsutani; Katutoki Sasaki, both of Yokohama, Japan

[73] Assignee: Kabushiki Kaisha Toshiba, Kawasaki, Japan

[21] Appl. No.: 632,461

[22] Filed: Jul. 19, 1984

[30] Foreign Application Priority Data

Jul. 26, 1983 [JP] Japan ..... 58-136604
May 21, 1984 [JP] Japan ..... 59-102024

[51] Int. Cl.[4] ..... F17C 13/00
[52] U.S. Cl. ..... 62/54; 62/514 R
[58] Field of Search ..... 62/6, 54, 514 R

[56] References Cited

U.S. PATENT DOCUMENTS 3,991,586 11/1976 Acord ..... 62/6
4,277,949 7/1981 Longsworth ..... 62/54
4,369,636 1/1983 Purcell et al. ..... 62/514 R
4,432,216 2/1984 Matsuda et al. ..... 62/514 R

FOREIGN PATENT DOCUMENTS 0015728 9/1980 European Pat. Off. .

*Primary Examiner*—Ronald C. Capossela
*Attorney, Agent, or Firm*—Oblon, Fisher, Spivak, McClelland & Maier

[57] ABSTRACT

A cold insulation vessel comprises an inner chamber in which cryogen is enclosed, an outer chamber to enclose this inner chamber and a shield member against heat radiation which is provided between the inner chamber and the outer chamber. This vessel is provided to hold a superconducting coil which is enclosed in the inner chamber at a very low temperature. A power lead is provided to supply an exciting current to this superconducting coil. A recondenser is provided to recondense the evaporated gas of the cryogen in the inner chamber. The small refrigerator means has a plurality of refrigeration stages which are directly coupled to the power lead and the recondenser.

11 Claims, 16 Drawing Figures

SUPERCONDUCTING MAGNET DEVICE

BACKGROUND OF THE INVENTION

This invention relates to a superconducting magnet device and, more particularly, to an improvement in such a device which has a smaller superconducting magnet and a smaller refrigerator and is used, for example, in a monocrystal fostering apparatus, magnetic resonance imaging (MRI) system and the like.

FIG. 1 shows the construction of the conventional superconducting magnet device. In the diagram, a superconducting coil 1 serving as a superconducting magnet is enclosed in an inner chamber 3 in which a cryogen, for example, liquid helium 2 at a very low temperature (e.g., at 4.2° K.) is filled. A cold insulation vessel 4 to hold this superconducting coil 1 into the superconducting state comprises: the inner chamber 3; an outer chamber 5 to enclose this inner chamber 3 ordinarily in the vacuum state; and a plate-like shield member 6 of thermal radiation which is interposed between the inner chamber 3 and the outer chamber 5. Further, the thermal radiation shield member 6 is provided with a tubular shield member 8 to raise the shielding effect thereof. On the other hand, an exciting current is supplied from an external power source 9 for the superconducting magnet through a power lead 10 to the superconducting coil 1. This enables the desired magnetic field to be applied to equipment 16 to which the magnetic field is applied. This equipment is arranged so as to penetrate through the central portion of the cold insulation vessel 4.

On the other hand, under such a situation, the heat penetrates from the outside space at an ordinary temperature (e.g., at 300° K.) into the liquid helium 2 which is held at a very low temperature (e.g., 4.2° K.) due to thermal conduction and thermal radiation through the power lead 10, a low temperature piping 11, a liquid helium transfer pipe 12, the outer chamber 5, the thermal radiation shield member 6, and the inner chamber 3. A part of the liquid helium 2 is ordinarily evaporated due to this penetration heat, so that gaseous helium 13 is generated. This gaseous helium 13 flows inside an outer pipe 14 in which the power lead 10 passes and enters the low temperature piping 11 while cooling (gas-cooling) the power lead 10. A quantity of penetration heat from the power lead 10 is reduced due to this gas-cooling. The gaseous helium 13 enters a helium liquefying apparatus 15 and is converted to liquid helium at a very low temperature (e.g., at 4.2° K.). This liquid helium is put into the inner chamber 3 through the liquid helium transfer pipe 12. As described above, after the helium evaporated by the penetration heat has been cooled by the power lead 10, it is liquefied by the helium liquefying apparatus 15 and is returned to the inner chamber 3. This circulation is repeated, thereby holding the superconducting coil 1 in the superconducting state.

On the other hand, although the conventional superconducting magnet device constructed as described above is suitable for a large superconducting magnet, it is improper for a relatively small superconducting magnet (e.g., the exciting current is about 300 to 500 A and the helium evaporation quantity is about 1 to 2 l/h at a very low temperature) which is used, for example, in a monocrystal fostering (putting-up) apparatus or the like as equipment 16 to which the magnetic field is applied. This is because the helium liquefying apparatus 15 of the conventional type has been developed for use in a large superconducting magnet, and it is not suitable for an apparatus having small refrigerating ability (e.g., the helium evaporation quantity is about 1 to 2 l/h). Therefore, if the ordinary helium liquefying apparatus 15 is employed in the small superconducting magnet, the size and the area occupied by the helium liquefying apparatus 15 will become extremely large as compared with the superconducting magnet. Further, with respect to the manufacturing cost, the cost of the helium liquefying apparatus 15 is much larger than the smaller superconducting magnet, which makes the superconducting magnet device extremely expensive. On the other hand, it is also possible to consider the method whereby the small refrigerator of the conventional type which equivalently corresponds to the capacity of this small superconducting magnet is used, thereby reducing the size and cost of the superconducting magnet device. However, the conventional small refrigerator doesn't have enough refrigerating ability to extinguish the heat penetrated through the cold insulation vessel 4, inner chamber 3, shield members 6 and 8, and outer chamber 5 to further cool the power lead 10. Therefore, ordinarily, a permanent current switch is attached to the superconducting coil and the power lead is made detachable; after the superconducting coil has been excited, the power lead is detached, thereby shutting off the heat which penetrates from the power lead; and the device is operated in the permanent current mode. With such a constitution, the heat is penetrated from the outside due to only the thermal radiation and the thermal conduction from various low-temperature pipes, so that the superconducting magnet can be sufficiently held into the superconducting state even by only the refrigerating ability of the conventional small refrigerator.

However, according to this technique, once the device has entered the permanent current mode, the exciting current is always constant and the current value cannot be varied. For instance, when considering the small superconducting magnet device which is used in the monocrystal pulling-up apparatus, it is required to control the impurity concentration in the monocrystal by changing or controlling the magnetic field strength while the monocrystal is being pulled up. For this purpose, it is necessary to control the magnetic field strength, i.e., the exciting current value. As described above, generally in the equipment using the superconducting magnet device, it is usually demanded that the strength of the magnetic field be applied thereto, i.e., the exciting current value can be varied or controlled.

SUMMARY OF THE INVENTION

Accordingly, an object of the present invention is to provide an improved superconducting magnet device, which can control the exciting current value in combination with the smaller refrigerator and smaller superconducting magnet, and which can which realize a compact device with a low cost.

In addition, another object of the present invention is to provide a superconducting magnet device wherein: the refrigerating ability of the small refrigerator can be controlled in accordance with a quantitative change in the penetration heat in association with a change in exciting current value of the superconducting coil; there is no fear of a mixture of an impurity into the piping system; the operating current flowing through the superconducting coil can be selected to a value within a wide range; the temperature or pressure of cryogen can be always controlled to a constant value; the operability is excellent; and it can be operated with high reliability for a long time period.

According to the present invention, a cold insulation vessel comprises an inner chamber in which cryogen is sealed, an outer chamber for enclosing this inner chamber, and a shield member of thermal radiation which is provided between the inner and outer chambers. This vessel is provided to hold a superconducting coil which is enclosed in the inner chamber at a very low temperature. A power lead is provided to supply an exciting current to the superconducting coil. A recondenser is provided to recondense the evaporated gas of the cryogen in the inner chamber. A small refrigerator having a plurality of refrigeration stages is provided, and these stages are directly coupled to the power lead and the recondenser.

With such an arrangement, it is possible to provide a superconducting magnet device which can control the exciting current value in combination with the smaller refrigerator and smaller superconducting magnet and which also can realize a compact and low-costing device.

BRIEF DESCRIPTION OF THE DRAWINGS

The present invention can be understood by reference to the accompanying drawings, in which.

DETAILED DESCRIPTION OF THE PREFERRED EMBODIMENTS

The first embodiment of this invention and the modified forms thereof will now be described with reference to FIGS. 2 to 4.

Figure 1:
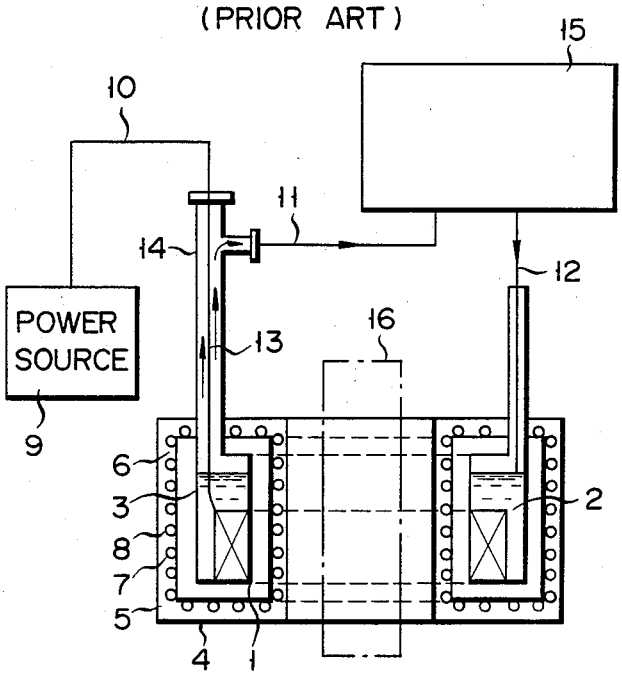
FIG. 1 (PRIOR ART)
FIG. 1 is a constitutional diagram showing the conventional superconducting magnet device.
Figure 2:
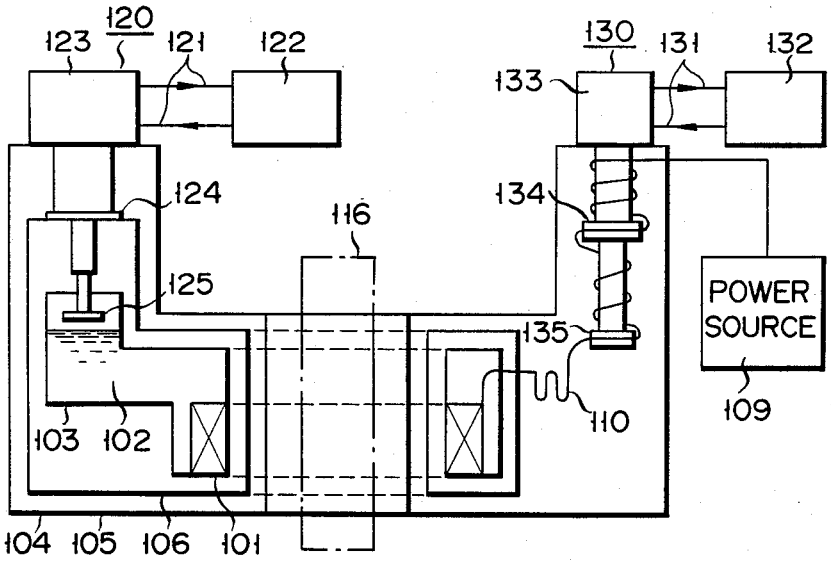
FIGS. 2 to 4 are constitutional diagrams showing the first embodiment of a superconducting magnet device according to the present invention and different modifications thereof.

FIG. 2 shows an example of the arrangement of the superconducting magnet device according to the first embodiment of the present invention, in which a superconducting coil 101 is enclosed in an inner chamber 103 sealed liquid helium 102 as cryogen. First and second small refrigerators 120 and 130 are directly attached to a cold insulation vessel 104. This first small refrigerator 120 comprises: a compressor unit 122 to compress a cryogen (e.g., helium) 121 which circulates in the refrigerator; an expander 123 to thermally insulate and expand the cryogen 121 compressed by the unit 122, thereby refrigerating; a first refrigeration stage 124 which is cooled to the temperature of the thermal radiation shield member, for example, to 80° K. by the cryogen 121 cooled by the expander 123; and a helium recondensing apparatus 125 which is cooled to the helium liquefying temperature, e.g., to 4.2° K. by the cryogen 121. The first refrigeration stage 124 is directly connected to a thermal radiation shield member 106 provided between an outer chamber 105 and the inner chamber 103 of the cold insulation vessel 104, while the helium recondenser 125 is provided in the position immediately over the liquid surface of the liquid helium 102 in the inner chamber 103.

On the other hand, the second small refrigerator 130 comprises: a compressor unit 132 to compress a cryogen 131 which circulates in the refrigerator; an expander 133 to expand the compressed cryogen 131 discharged therefrom, thereby refrigerating; a second refrigeration stage 134 which is cooled to, e.g., 80° K. by the cryogen 131 cooled by the expander 133; and a third refrigeration stage 135 which is cooled to, e.g., 20° K. by the cryogen 131.

In addition, a power lead 110 to supply an exciting current to the superconducting coil 1 passes from the liquid helium 102 through the inner chamber 103 and through the thermal radiation shield member 106. After the desired conduction length and conduction cross sectional area is employed, the power lead 110 is coupled to the third refrigeration stage 135. Further, after the desired conduction length and conduction cross-sectional area are employed, it is coupled to the second refrigeration stage 134. Finally, after the desired conduction length and conduction cross-sectional area are employed, it passes through the outer chamber 105 and is connected to a power source 109 for the superconducting magnet.

The coupling portions among the power lead 110 and the respective refrigeration stages 134 and 135 are electrically isolated. The penetrating portions of the helium recondenser 125 and power lead 110 which pass through the inner chamber 103 are so airtight that the evaporated gases from the liquid helium 102 in the inner chamber 103 don't leak to the outside of the inner chamber 103. Further, the conduction cross-sectional area of the power lead 110 between the outer chamber 105 and the second refrigeration stage 134 is larger than that between the second refrigeration stage 134 and the third refrigeration stage 135, while the latter area is larger than the conduction cross-sectional area of the power lead 110 between the third refrigeration stage 135 and the superconducting coil 101.

The operation of the superconducting magnet device constituted as described above will now be explained. First of all, to apply the magnetic field to equipment 116 to which the magnetic field has been applied (e.g., a monocrystal pulling-up apparatus), the superconducting coil 101 is excited through the power lead 110 by use of the power source 109 for the superconducting magnet. Thus, the liquid helium 102 starts evaporating due to: the Joule's heat according to the electrical resistance of the power lead 110; the penetration heat due to the thermal conduction through the power lead 110 according to the temperature difference between the temperature (e.g., 4.2° K.) of the liquid helium 102 and the atmospheric temperature (e.g., 300° K.); and the penetration heat due to the thermal radiation through the outer chamber 105, thermal radiation shield member 106 and inner chamber 103. Among those types of heat, the Joule's heat generated from the power lead 110 and the penetration heat due to the thermal conduction are effectively eliminated by the second small refrigerator 130 and the second and third refrigeration stages 134 and 135 as will be explained later.

Generally, the penetration heat from the power lead is such that the Joule's heat becomes small as the cross-sectional area of the power lead becomes large, but that of the penetration heat due to thermal conduction becomes large. On the contrary, as the cross-sectional area of the power lead becomes small, the Joule's heat increases and the penetration heat due to the thermal conduction decreases. Therefore, the optimum cross-sectional area of the power lead which minimizes the penetration of the heat exists. This optimum cross-sectional area is determined by the exciting current value, the temperatures and the refrigerating capabilities of the second and third refrigeration stages 134 and 135, and the conduction length of the power lead. Therefore, the penetration heat from the power lead 110 to the liquid helium 102 can be minimized by suitably selecting the conduction lengths and cross-sectional areas of the power lead 110 between the liquid helium 102 (e.g., at 4.2° K.) and the third refrigeration stage 135 (e.g., at 20° K.), between the third refrigeration stage 135 and the second refrigeration stage 134 (e.g., at 80° K.), and between the third refrigeration stage 135 and the outer chamber 105 (e.g., at 300° K.) in accordance with the refrigerating abilities of the second and third refrigeration stages 134 and 135 of the second small refrigerator 130.

This optimum condition can be obtained by, for instance, the following equation which is generally well known. Namely, when $$L/s = \frac{1}{\tau}\cos^{-1}\frac{T_c}{T_h}$$

in the equation $$Q = I\cdot\sqrt{\lambda\alpha}\cdot\frac{T_h - T_c\cos(\tau L/s)}{\sin(\tau L/s)},$$

the quantity of penetration heat becomes the minimum value $Q_{min}$ $$Q_{min} = I\cdot\sqrt{C\alpha(T_h^2 - T_c^2)}$$

where

Q: quantity of penetration heat,
I: current value,
$\lambda$: thermal conductivity,
$\alpha$: constant ($\rho=\alpha T$, $\rho$: resistivity of the power lead, T: temperature),
C: thermal conductivity,
$\tau$: $\tau=I\cdot\sqrt{\alpha/C}$,
$T_h$: temperature of the high-temperature portion,
$T_c$: temperature of the low-temperature portion,
s: cross sectional area of the power lead,
L: length of the power lead.

In this way, the penetration heat from the power lead 110 can be minimized and further there is no need to gas-cool the power lead 110 as in the conventional device; therefore, the quantity of evaporated helium is remarkably diminished to be as small as possible. Thus, the helium gas in the sealed inner chamber 103 which was evaporated by the penetration heat due to the thermal radiation or thermal conduction from various low-temperature pipes can all be reliquefied due to only the refrigerating capability of the small conventional refrigerator 120. Namely, after the latent heat of the evaporated gas from the liquid helium 102 has been taken by the helium recondenser 125 installed in the inner chamber 103, the evaporated gas is recondensed, so that it becomes liquid droplets. Then, the droplets are returned as the liquid helium 102 in the inner chamber 103 which is sealed. On the other hand, the thermal radiation shield member 106 is directly connected to the first refrigeration stage 124 (e.g., at 80° K.) of the first small refrigerator 120 and is directly cooled due to the thermal conduction from this first refrigeration stage 124. Due to this, a good thermal shield effect is derived with a compact arrangement.

According to the superconducting magnet device of the first embodiment as described above, the following effects are obtained.

(a) The power lead 110 is directly cooled by the second and third refrigeration stages 134 and 135 of the small conventional refrigerator 130. Therefore, the inner chamber 103 of the cold insulation vessel 104 can be sealed and the liquid helium 102 can be enclosed therein. Thus, the increase in volume of the evaporated helium can be avoided as compared with the conventional method of cooling the power lead by the use of evaporated helium gas. Further, since the quantity of helium evaporated in the inner chamber 103 is reduced, even in the case of the small conventional refrigerator, the evaporated helium in the inner chamber 103 can be sufficiently recondensed.

(b) The power lead 110 is directly cooled as mentioned above; therefore, the magnetic field strength, namely, the exciting current value can be arbitrarily changed without breaking the superconducting state even during the operation of the superconducting magnet device. As a result, for instance, in the case where the present device is applied to the superconducting magnet device for use in the monocrystal pulling-up apparatus, the impurity concentration in the monocrystal can be controlled by controlling the magnetic field strength.

(c) The thermal radiation shield member 106 is directly cooled due to the thermal conduction used in the first refrigeration stage 124 of the small refrigerator 120, so that the device can be made compact by only the volume corresponding to the improvement in the thermal radiation shield effect.

(d) The device is constructed in the manner such that the small refrigerators 120 and 130 of the conventional types which can match the size and capacity of the small superconducting magnet are directly attached to the cold insulation vessel 104; therefore, a compact and low-cost device can be realized.

Next, the modified forms of the first embodiment of the present invention as explained above will be described.

Figure 3:
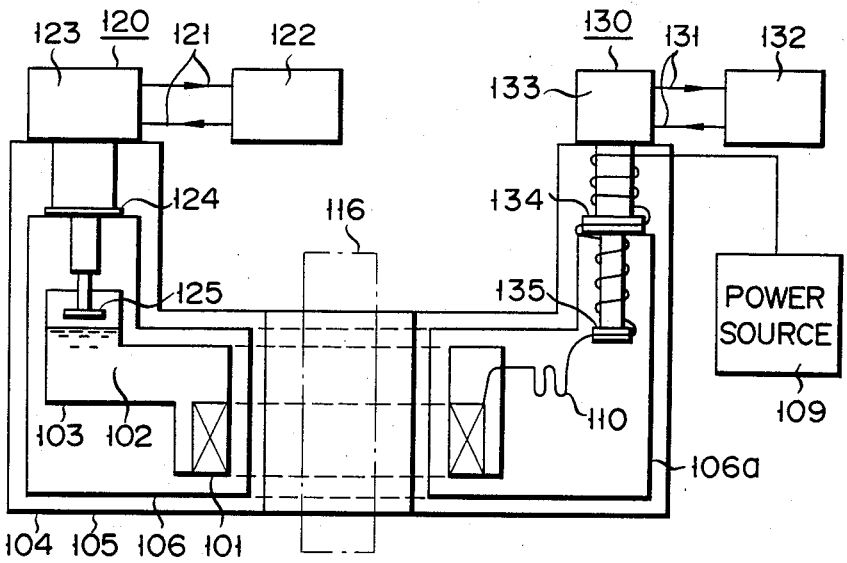

FIG. 3 shows an example of another modified form of the superconducting magnet device according to the first embodiment of the present invention, and the same parts and components as those shown in FIG. 2 are designated by the same reference numerals and their descriptions will be omitted. In this modification, the temperature of the second refrigeration stage 134 of the second small refrigerator 130 to cool the power lead 110 is made identical to the temperature of the first refrigeration stage 124 of the first small refrigerator 120, and a thermal radiation shield member $106_a$ directly attached to the respective refrigeration stages 134 and 124. With such an arrangement, the refrigerating capability of the thermal radiation shield member $106_a$ is raised, so that the thermal shield effect is correspondingly improved. At the same time, the power lead 110 between the liquid helium 102 and the second refrigeration stage 134 is thermally shielded by the thermal radiation shield member $106_a$ at the relevant temperature (e.g., at 80° K.), so that the penetration heat quantity from the power lead 110 is further reduced.

Figure 4:
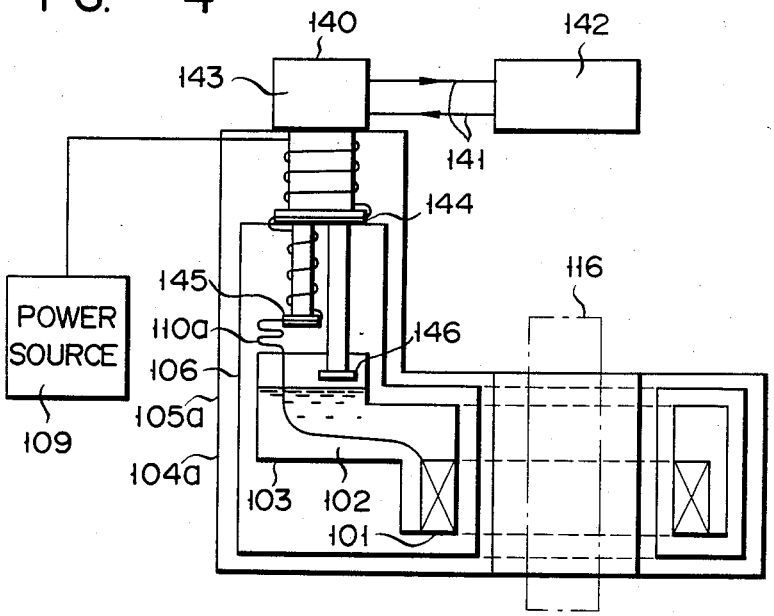

FIG. 4 also shows another modification of the superconducting magnet device according to the first embodiment of this invention, and as the same parts and components as those shown in FIG. 2 are designated by the same reference numerals, their descriptions will be omitted. In this modification, a small refrigerator 140 is directly attached to an outer chamber $105_a$ of a cold insulation vessel $104_a$. This refrigerator 140 has a compressor unit 142, an expander 143, and three refrigeration stages 144, 145 and 146. These stages are set so that those temperatures sequentially become lower (e.g., 80° K., 20° K. and 4.2° K.). Due to this, the evaporated helium in the inner chamber 103 recondenses simultaneously with the cooling of the power lead $110_a$. With such an arrangement, the further compact superconducting magnet device can be obtained.

As described above, according to the first embodiment of this invention and the respective modified forms thereof, it is possible to provide a compact and low-costing superconducting magnet device which can control the exciting current value in combination with the smaller refrigerator and smaller superconducting magnet.

Next, the second embodiment of this invention and the modified forms thereof will be described with reference to FIGS. 5 to 15.

Figure 5:
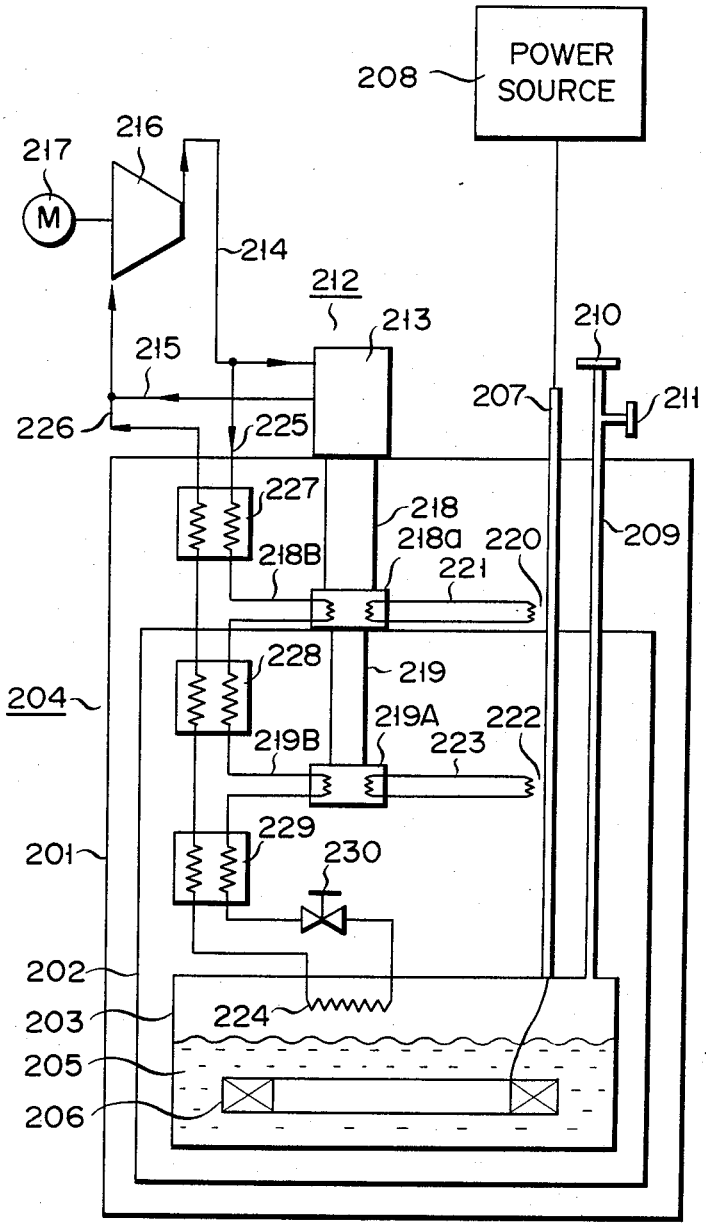
FIG. 5 is a diagram showing the fundamental arrangement of the second embodiment of the superconducting magnet device according to the present invention.

FIG. 5 shows the fundamental example of the superconducting magnet device according to the second embodiment of this invention. Its arrangement is similar to that of the modification shown in FIG. 4 in the first embodiment mentioned above.

Namely, a thermal radiation shield member 202 is disposed in an outer chamber 201, and an inner chamber 203 is disposed inside the shield member 202. A cold insulation vessel 204 is constituted by those components. Liquid helium 205 is enclosed in the inner chamber 203 and this liquid helium is cooled to a very low temperature, e.g., 4.2° K. by a small refrigerator which will be described later. A superconducting coil 206 is supported in the inner chamber 203 by a superconducting coil supporting member (not shown). This superconducting coil 206 is electrically connected to one end of a power lead 207. The other end of the power lead 207 is located in the space at an ordinary temperature outside of the cold insulation vessel 204. The other end of the power lead 207 is electrically connected to an external power source 208, thereby enabling the superconducting coil 206 to be excited. One end of a bursting piping 209 is coupled to the inner chamber 203 so as to burst the abnormal helium gas pressure generated in the inner chamber 203 to the outside of the outer chamber 201. The other end of the bursting piping 209 is located in the external space and at the same time, it is coupled to a mechanical bursting apparatus 210 and a bursting apparatus 211 of the rupture disc type.

The mechanical bursting apparatus 210 is constituted in the manner such that the valve member is opened when the pressure exceeds a predetermined pressure, and the valve member is closed when the pressure is less than the predetermined pressure. The rupture disc type bursting apparatus 211 is constituted such that the member which closes the opening portion thereof is ruptured when the abnormal pressure occurred.

For instance, a small sized (helium) refrigerator of the conventional type (hereinbelow, referred to as a refrigerator) 212 is used as the above-mentioned smallsized refrigerator and it is constituted as will be explained below. A refrigerator head 213 is provided on the external upper wall surface of the outer chamber 201. A compressor 216 to compress helium is connected to a cryogen inflow piping 214 and to cryogen return piping 215 of the refrigerator head 213. A motor 217 to drive the compressor 216 is directly coupled thereto. A first refrigeration stage 218 to cool the power lead 207 and thermal radiation shield member 202 is in the refrigerator head 213. This stage 218 is disposed outside the thermal radiation shield member 202 in the outer chamber 201. A second refrigeration stage 219 to cool the power lead 207 is used as the first refrigeration stage 218. This stage 219 is disposed in the thermal radiation shield member 202. Each of the first and second refrigeration stages 218 and 219 comprises: a piston (not shown) which is driven by a piston driving mechanism (not shown) equipped in the refrigerator head 213, thereby compressing and expanding helium; cold temperature holding material (not shown) to hold the cold temperature of helium which is cooled due to the actions of the compression and expansion of this piston; and members, e.g., flanges 218A and 219A which are used for both mechanical supporting and thermal conduction. The flange 218A of the first refrigeration stage 218 is mechanically connected to the thermal radiation shield member 202 so that the heat is transferred thereto. On the other hand, the flange 218A of the first refrigeration stage 218 and a heat station 220 at the first stage of the power lead 207 are mechanically connected through a heat transfer member 221 having good thermal conductivity so that the heat can be transferred therebetween. Further, the flange 219A of the second refrigeration stage 219 and a heat station 222 at the second stage of the power lead 207 are similarly connected through a heat transfer member 223.

A helium recondensing apparatus (hereinbelow, referred to as a recondenser) 224 is provided in the inner chamber 203 to recondense the helium gas generated due to the evaporation of the liquid helium 205 inside. Each end of a J - T (Joule - Thomson) inflow piping 225 and a J - T return piping 226 is connected to the inlet side and to the outlet side of the recondenser 224, respectively. The other end of the J - T inflow piping 225 and J - T return piping 226 is connected to the cryogen inflow piping 214 and to the cryogen return piping 215 which are connected to the inlet side and the outlet side of the refrigerator head 213, respectively. Halfway down the J - T inflow piping 225 and J - T return piping 226, the inflow side of a heat exchanger 227 at the first stage, the inflow side of a heat exchanger 228 at the second stage, and the inflow side of a heat exchanger 229 at the third stage are connected in series.

A heat transfer member 218B extending from the flange 218A of the first refrigeration stage 218 is fixed to the J - T inflow piping 225 at the halfmark of which the first-stage heat exchanger 227 and second-stage heat exchanger 228 are connected so that the member 218B penetrates the piping 225. On the other hand, a heat transfer member 219B extending from the flange 219A of the second refrigeration stage 219 is fixed to the J - T inflow piping 225 at the halfmark of which the second-stage heat exchanger 228 and third-stage heat exchanger 229 are connected so that the member 219B penetrates the piping 225. A J - T valve 230 is provided for the J - T inflow piping 225 at the halfmark of which the third-stage heat exchanger 229 and recondenser 224 are connected. The outflow sides of the heat exchangers 227, 228 and 229 at the first, second and third stages are connected in series to the J - T return piping 226. The refrigerator 212 is thus constituted.

Subsequently, the operation of the superconducting magnet device as a fundamental example of the second embodiment which was constituted as mentioned above will be explained.

One end of the power lead 207 is located in the space at an ordinary temperature (e.g., 300° K.), while the other end thereof is located inside the inner chamber 203 through the outer chamber 201 and thermal radiation shield member 202. Therefore, the heat from the space at the ordinary temperature penetrates into the inner chamber 203 due to the actions of the power lead 207, namely, the thermal conduction and thermal radiation, so that the liquid helium 205 at a very low temperature (e.g., at 4.2° K.) is evaporated.

To minimize the evaporation of the liquid helium 205, the thermal radiation shield member 202 is provided in the outer chamber 201. This thermal radiation shield member 202 is cooled to 70°–100° K. by the first refrigeration stage 218 as will be explained later. The largest heat of the several types of penetration heat from the external space at an ordinary temperature is the penetration heat which is transferred through the power lead 207. To decrease this penetration heat, the power lead 207 is forcedly cooled by the first-stage heat station 220 which is cooled to 70°–100° K. and by the second-stage heat station 222 which is cooled to 10°–20° K. as will be explained later.

Ordinarily, the quantity of the liquid helium 205 in the inner chamber 203 that is evaporated is a small value, 1–2 l/h, due to the reduction of the penetration heat as mentioned above. This evaporated helium gas is condensed (liquefied) by the recondenser 224 which has been refrigerated at 4.2° K. and which becomes the liquid helium that is returned into the inner chamber 203 as will be explained later. In this way, the superconducting magnet device can be continuously operated without injecting the liquid helium again.

On the other hand, in the fundamental example of the second embodiment constituted in this way, the quantity of heat penetrated through the power lead 207 is proportional to the exciting current value from the external power source 208 as shown in the following equation:

$$Q_p = I \cdot \sqrt{C \cdot \alpha(T_h^2 - T_c^2)}$$

where, $Q_p$: quantity of penetration heat from the power lead 207,

I: exciting current value, $\alpha$: constant ($\rho = \alpha T$, $\rho$: resistivity of the power lead, T: temperature), C: thermal conductivity of the power lead 207, $T_h$: temperature of the high-temperature portion, $T_c$: temperature of the low-temperature portion.

For example, when $T_h$ is set to a temperature of 10° to 20° K. of the second-stage heat station 222 and $T_c$ is set to the temperature of 4.2° K. of the liquid helium 205, $Q_p$ becomes the penetration heat quantity of the liquid helium, and the liquid helium is evaporated by the quantity corresponding to the heat of the vaporization responsive to this heat. In the case where it is necessary to vary the magnetic field generated by the superconducting coil 206 (for example, in the case where it is used in the monocrystal fostering apparatus and the MRI system), the exciting current value I is changed in proportion to the magnetic field strength. Thus, the penetration heat quantity $Q_p$ is varied in response to this according to the above equation. Therefore, the evaporation quantity of liquid helium is also varied.

The refrigerating operation of the refrigerator 212 will then be considered.

The cryogen in the compressor 216, i.e., the helium gas in this case is driven and compressed by the motor 217 and passes through the cryogen inflow piping 214, refrigerator head 213, first refrigeration stage 218, second refrigeration stage 219, and cryogen return piping 215 before returning to the compressor 216. Namely, the cryogen flows in the circulation loop constituted in this way. At this time, the helium gas is expanded in the refrigerator head 213 in the thermal-insulation manner, so that the first refrigeration stage 218 is cooled to 100°–70° K. and the second refrigeration stage 219 is cooled to 10°–20° K. due to the reception and transfer of the heat at this time. On the other hand, the helium gas discharged from the compressor 216 is partially diverged by the cryogen inflow piping 214 and flows into the J - T inflow piping 225. This diverged helium gas passes through the first-stage heat exchanger 227, first refrigeration stage 218, second-stage heat exchanger 228, second refrigeration stage 219, and third-stage heat exchanger 229 to become helium gas having a very low temperature below the reverse temperature (e.g., below 20° K.) from the superconduction to the ordinary conduction. This very low temperature helium becomes the gas-liquid two-phase flow when it has a temperature of, e.g., at 4.2° K., due to the so-called Joule-Thomson effect when it passes through the J - T valve 230. Then it flows into the recondenser 224. Thus, the helium gas evaporated in the inner chamber 203 as mentioned above is again liquefied by the recondenser 224 to become liquid helium before it is returned to the inner chamber 203. The helium gas discharged from the recondenser 224 passes through the third-stage heat exchanger 229, second-stage heat exchanger 228, first-stage heat exchanger 227, and J - T return piping 226 and is returned into the compressor 216.

Figures 6A, 6B:
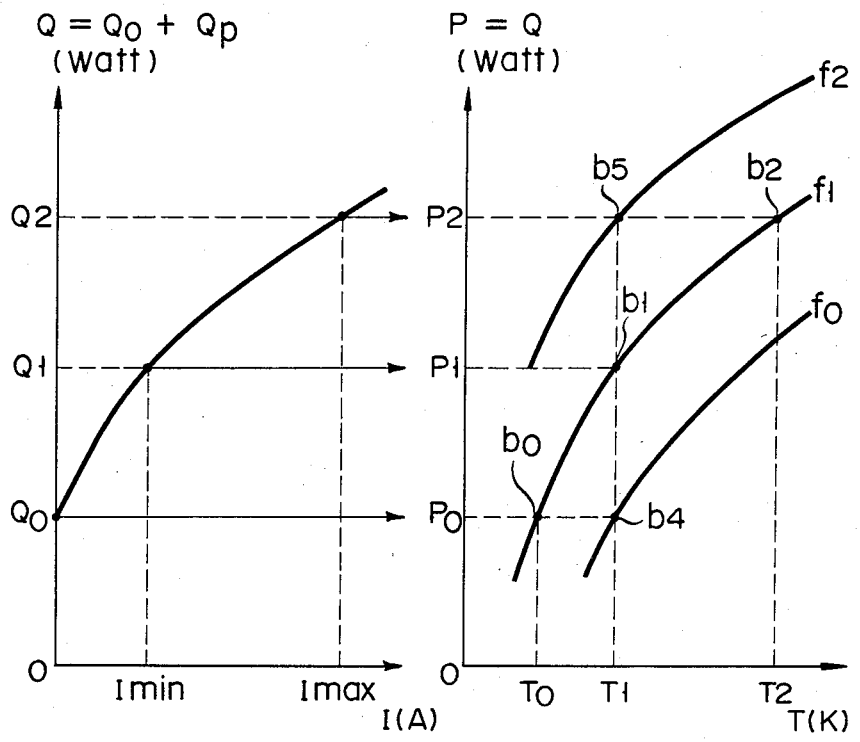
FIGS. 6(*a*) and 6(*b*) are characteristic curve diagrams showing the relation between the quantity of penetration heat versus the exciting current to the superconducting coil in the second embodiment and showing the relation between the refrigerating capability of the refrigerator and the above-mentioned exciting current.

FIG. 6(*b*) shows the curve indicative of the refrigerating capability by the recondenser 224 according to this refrigerator 212. The axis of the abscissa indicates the temperature T (K) of the helium gas in the recondenser 224; the axis of ordinate represents the refrigerating capability P (Watt) thereof; and $f_0$, $f_1$ and $f_2$ indicate the operating frequencies of the motor 217 (e.g., $f_1 = 50$ Hz in this case). FIG. 6(*a*) shows the curve representing the quantity Q of penetration heat into the liquid helium 205 versus exciting current value I.

In this case, $Q=Q_0+Q_p$. $Q_p$ denotes the penetration heat quantity from the power lead 207 which is indicated in the above equation. In addition, $Q_0$ denotes the quantity of heat which penetrates through a superconducting coil supporting member (not shown) and through the thermal radiation shield member 202. $Q_0$ is also substantially a constant value which is independent of the exciting current value. When the value of the exciting current to the superconducting coil 206 is the minimum value $I_{min}$, the quantity of penetration heat into the liquid helium 205 becomes $Q_1$ from FIG. 6(*a*). The refrigerating capability by the recondenser 224 of $P_1=Q_1$ is required to recondense all of the helium gas evaporated due to this heat quantity $Q_1$. From FIG. 6(*b*), in this case, the refrigerator 212 operates at point $b_1$ on the refrigerating capability curve at the operating frequency of $f_1$. At this time, the temperature of the cryogen and the temperature of the liquid helium 205 which is in the balanced state therewith becomes $T_1$.

Next, when the exciting current is raised and the superconducting coil 206 is operated at the maximum value $I_{max}$ of the exciting current, the penetration heat quantity into the liquid helium 205 becomes $Q_2$ from FIG. 6(*a*). In this case, the refrigerating capability of $P_2=Q_2$ is needed and from FIG. 6(*b*), the refrigerator 212 is operated at point $b_2$ on the refrigerating capability curve at the operating frequency of $f_1$. The temperature of the liquid helium 205 at this time becomes $T_2$. Similarly, when the driving of the superconducting coil 206 is stopped and when the exciting current is set to zero, $Q_0=T_0$, so that the refrigerator 212 is operated at point $b_0$ on the refrigerating capability curve at the operating frequency of $f_1$, the temperature of the liquid helium 205 becomes $T_0$. However, the operating frequency of the motor 217 is the constant value of $f_1$.

Now, the operating temperature of the superconducting coil 206 will be considered. In this case, as the superconducting coil 206, for example, the coil of which the Nb-Ti superconducting wires are wound is used and it is generally designed so that the operating temperature is about 4.2° K. The design permissive temperature margin is at most about plus 1° K. A higher permissive temperature margin exceeding this value may easily cause the so-called quench, namely, the ordinary conducting transposition of the superconducting coil 206, will can result in damage to the superconducting coil 206.

In the case of FIG. 6(*b*), when $T_1$ is set to the design operating temperature (e.g., 4.2° K.) $T_2$ becomes $T_2=T_1+1$ (e.g., 5.2° K.) and $T_0$ becomes $T_0<T_1$. Since the liquid helium 205 is maintained substantially at the atmospheric pressure at 4.2° K., it has a negative pressure at the temperature of $T_0$. Namely, the negative pressure phenomena occurs in the inner chamber 203 and recondenser 224, and in the J - T inflow piping 225, J - T return piping 226 and J - T valve 230 which are located near the vessel 203 and recondenser 224.

Under such a situation, impurities such as water, nitrogen, oxygen, and the like in the atmosphere get mixed into the J - T piping system (a general denomination of the J - T inflow piping 225 and J - T return piping 226) able it by a very small quantity on the order of ppm through the welded portions of the inner chamber 203, welded portions of the recondenser 224, shielded portions, shielded portions of the J - T valve 230 with the atmosphere, and the like. Since the impurities mixed into the J - T piping system are solidified at temperatures below 4.2° K., if this operating state continues for a long time, particularly, the J - T piping system having thinner piping diameters than those of the cryogen inflow piping 214 and cryogen return piping 215 will be easily choked due to the impurities. Thus, the refrigerator 212 often cannot perform efficiently.

To prevent the occurrence of such a negative phenomena, it is preferable that $T_0>4.2°$ K. and that the J - T piping system and the inner chamber 203 become pressurized over the atmospheric pressure even when in the nonexciting state. However, in this case, since the operating temperature is limited such that $T_2<5.2°$ K. or $T_2-T_0\approx 1°$ K. the range between $I_{min}$ and $I_{max}$ cannot be as wide as the case where $T_0<4.2°$ K. Namely, the magnetic field variable region becomes narrow, so that it is possible that the device cannot be used, for instance, in the monocrystal fostering apparatus or MRI system. Further, when the refrigerator 212 changes its respective operating points $b_0$, $b_1$ and $b_2$ as indicated in FIG. 6(*b*), the refrigerating capability when $P=Q$ adversely changes its amount of penetration heat due to the change in the exciting current value. Namely, the time constant of the change in the refrigerating capability is so large that it may be, for instance, several hours. Therefore, when the exciting current value varies, the time constant of the change in the exciting current is smaller than the time constant of the change in refrigerating capability of the refrigerator 212. Consequently, the superconducting magnet device is operated in the state where the penetration heat quantity and the refrigerating capability are always unbalanced. For example, when the exciting current value is increased, the penetration heat quantity from the outside increases in response to the exciting current value; however, the refrigerating capability of the recondenser 224 hardly changes at all. Thus, evaporation of the liquid helium 205 rapidly increases, as does the pressure of the sealed inner chamber. When the pressure of the inner chamber exceeds the design pressure, the evaporated helium gas is discharged from the mechanical bursting apparatus 210 provided in the cold insulation vessel 204. If the following property of the refrigerating capability is bad, in the worst case, the penetration heat quantity and the refrigerating capability will appear to be balanced, despite the fact that the liquid helium 205 stored in the inner chamber 203 has completely been evaporated and drained into the atmosphere by mechanical bursting apparatus 210 before this operation is stopped. Or, there is also a case where the inner chamber pressure too rapidly increases, so that the rupture disc type bursting apparatus 211, causes the liquid helium 205 to be completely discharged into the atmosphere. In such a case, there is a method whereby the opening of the J - T valve 230 is manually changed to search the balance point. However, this adjustment is difficult and can only be satisfactorily performed by an experienced operator. Therefore, the superconducting magnet device constituted as the fundamental example mentioned above has the drawback that the driving operation is difficult, and that it can not be reliably operated for a long time.

Figure 7:
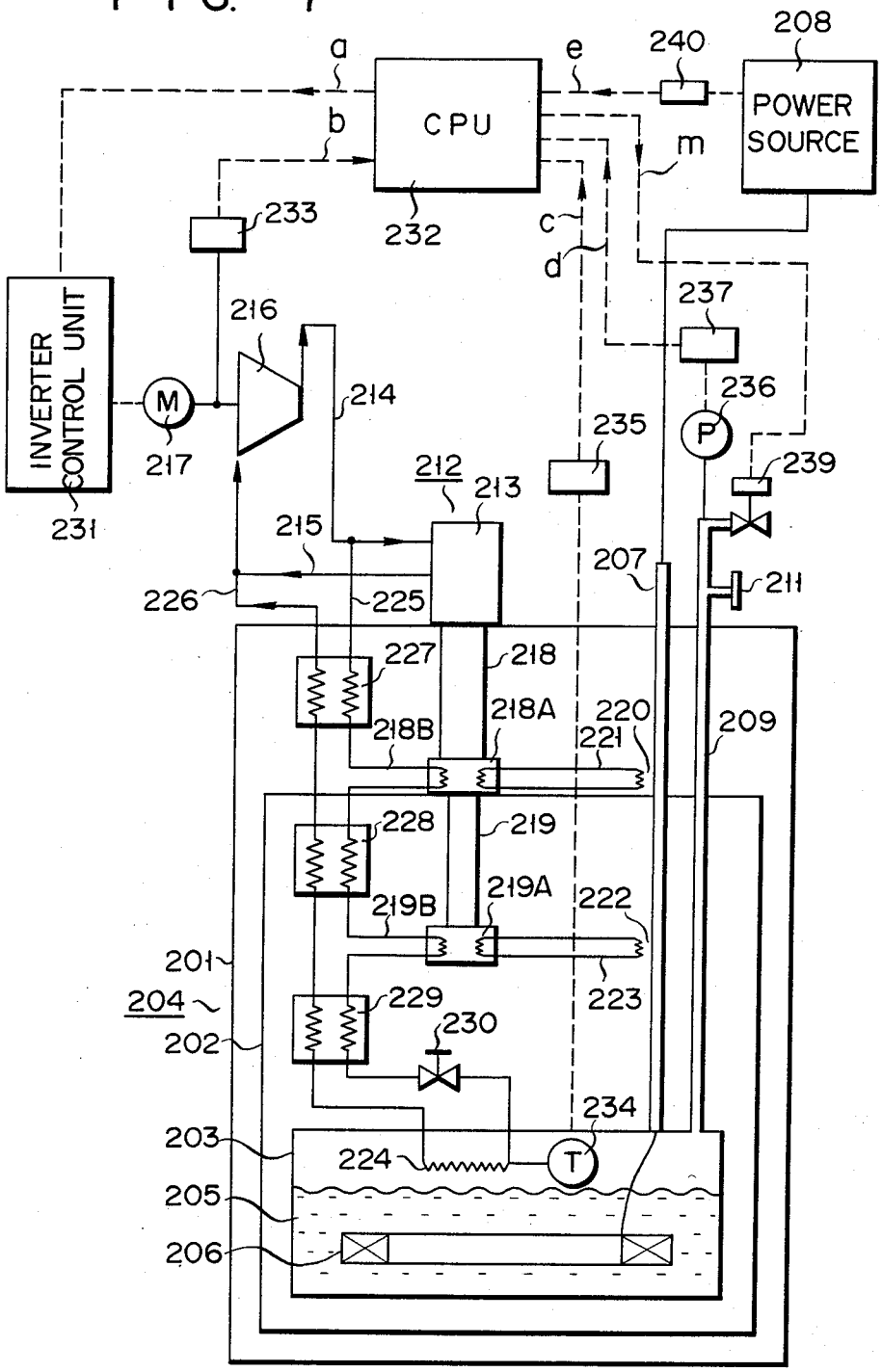
FIG. 7 is a diagram showing the arrangement to which the second embodiment was applied.

Due to this, this second embodiment adopts the arrangement shown in FIG. 7 in which the fundamental example shown in FIG. 5 is further improved.

In FIG. 7, the same parts and components as those shown in FIG. 5 are designated by the same reference numerals and their descriptions will be omitted. The motor 217 to drive the compressor 216 is constituted in the manner as follows to control its rotating speed. An inverter variable speed control unit 231 is electrically connected to the motor 217. A frequency set signal a from a central processing unit (CPU) 232 which will be explained later is output to this inverter variable speed control unit 231.

The rotating speed of the motor 217 is measured by a rotating speed measuring instrument 233, and the measured value is converted to an electric signal to obtain a control signal b. This control signal b is input to the CPU 232. The temperature of the recondenser 224 is measured by a temperature measuring instrument 234. This measured value is converted to an electric control signal c by a converter 235. This control signal c is input to the CPU 232. On the other hand, the pressure of the inner chamber 203, i.e., the pressure of the bursting piping 209 is measured by a pressure measuring instrument 236. This measured value is converted to an electric control signal d by a converter 237. This control signal d is input to the CPU 232. In addition, the exciting current value I of the external power source 208 is converted to a control signal e by a converter 240 and is input to the CPU 232. The above-mentioned mechanical bursting 210 is not provided for the bursting piping 209, but an automatic valve 239 such as a solenoid valve or motor valve or the like is provided in place of it. An on/off signal m from the CPU 232 is input to this automatic valve 239.

The CPU 232 performs the predetermined arithmetic processings on the basis of the input control signal b based on the rotating speed of the motor 217, control signal c based on the temperature of the recondenser 224, control signal d based on the pressure of the bursting piping 209, and control signal e based on the exciting current of the superconducting coil 206, thereby obtaining the penetration heat quantity Q from the outside by use of the exciting current value having the content shown in FIG. 6(*a*), and outputting the frequency set signal a which should be controlled corresponding to this Q, to the inverter variable speed control unit 231. In addition, the CPU 232 gives an on/off signal m to the automatic valve 239 in accordance with the controls shown in FIGS. 8, 9 and 10.

Next, the operation of the superconducting magnet device according to the second embodiment of the present invention which was constituted in this way will be explained. The following relation is satisfied between the operating frequency f of the motor 217 and the refrigerating capability P of the refrigerator 212:

$$P=k\cdot f$$

where, k is the proportional constant.

As shown in FIG. 6(*b*), the refrigerating capability curves $f_0$, $f_1$ and $f_2$ are obtained for the various operating frequencies f. In the diagram, the curve indicated by $f_0$ is obtained in the case where the operating frequency was selected so as to have the refrigerating capability of $P_0$ at the temperature of $T_1$. Similarly, the operating frequencies are selected so that the refrigerating capability becomes $P_1$ at $T_1$ for the operating frequency of $f_1$ and $P_2$ at $T_1$ for $f_2$. In this case, $f_0<f_1<f_2$, and $f_1$ is the operating frequency when the rotating speed of the motor 217 is not controlled as shown in FIG. 5. The case where the value of the exciting current to the superconducting coil 206 is zero will be first considered. In FIG. 6(*b*), although the refrigerator 212 is operated at point $b_0$ in the device of FIG. 5, the operating frequency is changed to have the value of $f_0$ by the inverter variable speed control unit 231 in the device of FIG. 7, whereby the operating state of the refrigerator 212 is set to the point indicated by $b_4$.

Figure 8:
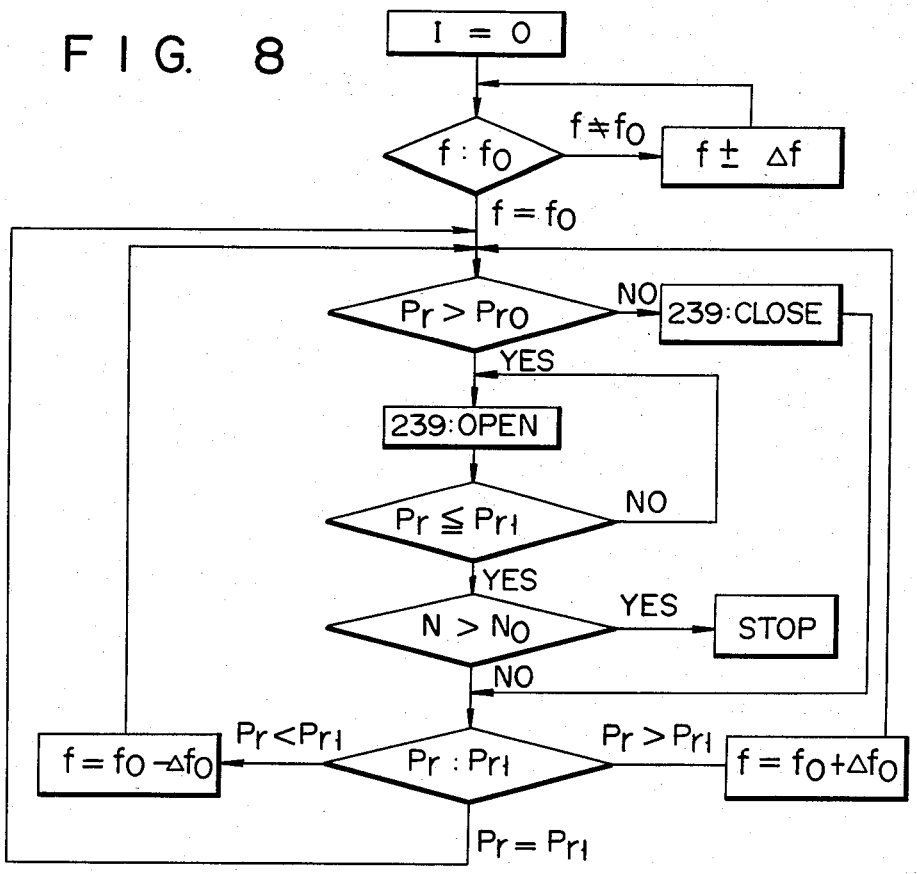
FIGS. 8 to 10 are flow charts to explain the operation of FIG. 7 and a diagram showing the variation in frequency of the motor.

At this time, the CPU 232 acts in accordance with the flow chart shown in FIG. 8. Namely, the CPU 232 controls in the manner such that the operating frequency f is first set to $f_0$ to correspond to the exciting current I of zero. Then the actual operating frequency f is held to the set value $f_0$ through the rotating speed measuring instrument 233 and inverter variable speed control unit 231. When $f\neq f_0$ as in this case, the fine variation amount of $\Delta f$ is added or subtracted so that $f=f_0$. It is assumed that $P_{rl}$ is the pressure in the inner chamber 203 which is unconditionally thermodynamically determined for the temperature of the recondenser 224 and that the temperature $T_1$ (e.g., 4.2° K.) of the liquid helium 205 is balanced therewith. It is also assumed that $P_{r0}$ indicates the design permissive pressure in the inner chamber 203 which is lower than the inner chamber 203 pressure at which the rupture disc type bursting apparatus 211 will be ruptured. In this case, $P_{r0}>P_{r1}$.

The driving control is performed in accordance with the following sequence.

(1) The pressure $P_r$ in the inner chamber 203 and the design permissive pressure $P_{r0}$ in the inner chamber are compared. When $P_r>P_{r0}$, the automatic valve 239 is opened, thereby bursting until $P_r=P_{r1}$. The number N of these opening operations is counted. When this operation is frequently performed and N becomes larger than $N_0$ in a constant time period, this means that control is impossible, and the driving of the refrigerator 212 is stopped. When $P_r<P_{r0}$, the processing advances to (2).

(2) $P_r$ and $P_{r1}$ are compared. When $P_r=P_{r1}$, this state is maintained. When $P_r<P_{r1}$, the frequency is decreased by the fine variation amount of $\Delta f_0$, thereby reducing the refrigerating capability and increasing the quantity of evaporated helium which increases the pressure in the inner chamber 203. When $P_r>P_{r1}$, the frequency is increased by the fine variation amount of $\Delta f_0$, thereby raising the refrigerating capability and increasing the quantity of recondensed helium gas to reduce the pressure in the inner chamber 203. After these operations, $P_r$ and $P_{r1}$ are again compared. By repeating steps (1) and (2), the operation of the refrigerator 212 is controlled as indicated by $b_4$ on the characteristic curve in FIG. 6(*b*).

The case whereby the superconducting coil 206 is excited and is held at the value of $I_{min}<I<I_{max}$ by energizing will next be considered. For example, the case where $I=I_{max}$ will be explained hereinbelow. In FIG. 6(*b*), the refrigerator 212 is operated at the point $b_2$ in the device shown in FIG. 5; however, in the device of FIG. 7, the operating state of the refrigerator 212 is controlled to point $b_5$ by changing the operating frequency to the value of $f_2$. At this time, the CPU 232 performs control in accordance with the flow chart shown in FIG. 10. The driving control is performed in accordance with the sequence of (3) and (4).

Figure 9:
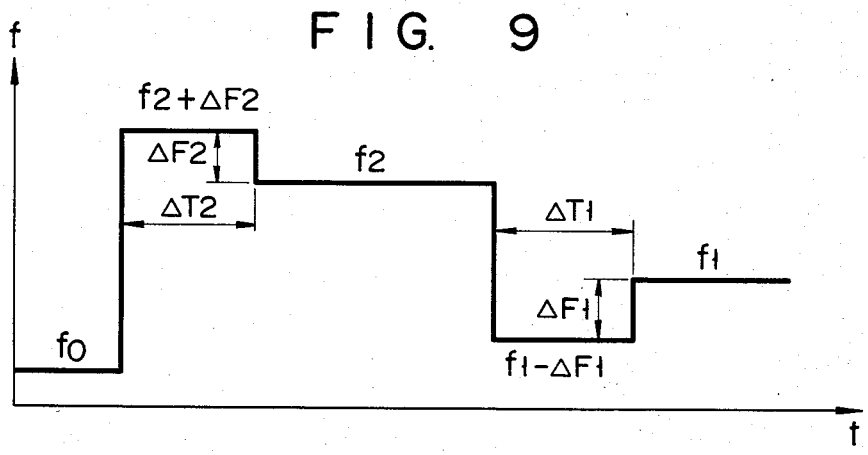
Figure 10:
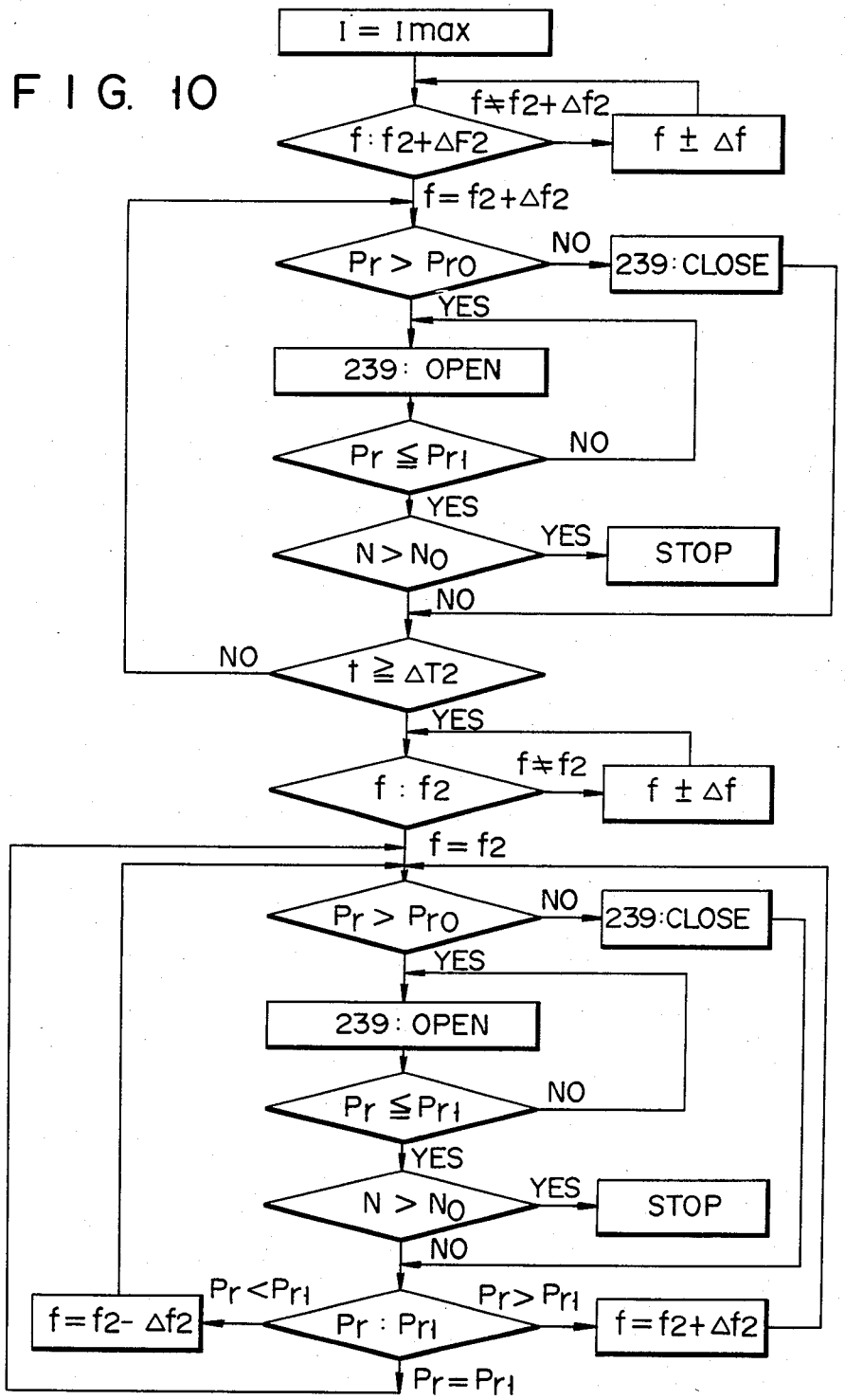

(3) When setting the frequency of $f_2$ corresponding to the desired exciting current value $I_{max}$, the operating frequency is changed as shown in FIG. 9. Namely, to improve the following property in association with the change in refrigerating capability, the operating frequency is overshot for the time interval of $\Delta T_2$ at the operating frequency of $f=f_2+\Delta F_2$ ($\Delta F_2$ : overshoot amount).

In this case, the values of $\Delta F_2$ and $\Delta T_2$ are set to have the optimum values on the basis of the change in the refrigerating capability of the refrigerator which is used. After overshooting, the operating frequency is fixed to $f_2$, and the operating frequency is controlled to have a constant value that is similar to the case where $I=0$.

(4) The operating frequency is controlled so that $P_r=P_{r1}$ as in the case where $I=0$.

By repeating steps (3) and (4), the operating state of the refrigerator 212 is equal to point $b_5$ on the characteristic curve in FIG. 6(*b*).

Next, the case where the superconducting coil 206 is deexcited and is held to the value of $I_{min}<I<I_{max}$ by energizing will be considered. In this case, the control which is substantially similar to the above-mentioned excitation case is performed except that the method of changing the operating frequency is different. That is, in FIG. 9, the frequency becomes $f_1$ from $f_2$ through $(f_1-\Delta F_1)$ and in the flow chart of FIG. 10, $I=I_{max}$ is substituted by $I=I_{min}$, and the frequencies of $f_2$ and $\Delta F_2$ are respectively replaced by $f_1$ and $\Delta F_1$.

As described above, according to the second embodiment of this invention, the rotating speed of the motor 217 to drive the compressor 216 of the refrigerator 212 can be controlled. Thus, the refrigerating capability of the refrigerator 212 can be controlled to correspond to the variation in the quantity of penetration heat in association with the change in the exciting current value which is given to the superconducting coil 206 by the external power source 208. Moreover, as this control response property is good and the refrigerating capability despite variations in the quantity of penetration heat is also good, the exciting current applied to the superconducting coil 206 can have a wide range. Further, since the negative pressure phenomenon of the J - T piping system is avoided, no impurity will be mixed into the piping system near the J - T valve 230. In this way, the capability of the refrigerator 212 will not decrease, and so the operability is excellent. In addition, since the capability of the refrigerator 212 is controlled by the control of the rotating speed of the motor, the degradation in refrigerating capability with time can be compensated for as will be explained later, so that the refrigerator 212 can be stably operated for a long time period. Further, since the motor 217 is controlled by the inverter variable speed control unit 231, the electric power consumption in the motor 217 can be suppressed to a minimum. Therefore, a highly reliable operation can be performed for a long time period.

Figure 11:
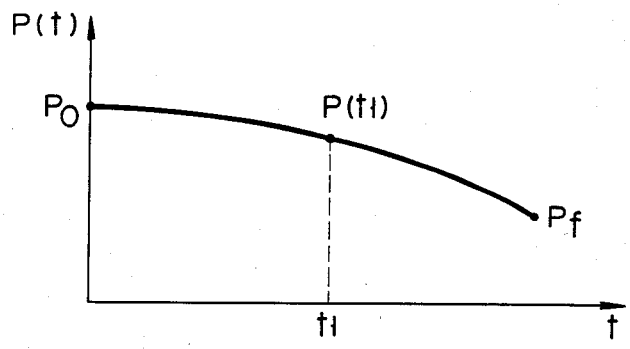
FIGS. 11 to 13 are diagrams showing the variation in refrigerating capability in FIG. 7 with the time elapse and the compensating functions thereof.

Next, in the case where the superconducting magnet device of the second embodiment of this invention mentioned above is continuously operated for a long time period, the function to compensate the degradation of the refrigerating capability of the refrigerator 212 with the elapse of time will be explained. First of all, an example thereof will be described with reference to FIGS. 11 and 12. The refrigerating capability P of the refrigerator 212 generally deteriorates with time as shown in FIG. 11, and can be expressed by the time function P(t). In this graph, $P_0$ indicates the initial refrigerating capability and $P_f$ represents the refrigerating capability of the refrigerator when it needs maintenance. When the superconducting magnet device is designed, the relation of $P_f>\epsilon P_2$ has to be satisfied, where $\epsilon$ indicates a safety factor and $P_2$ represents the refrigerating capability in FIG. 6(*b*).

Figure 12:
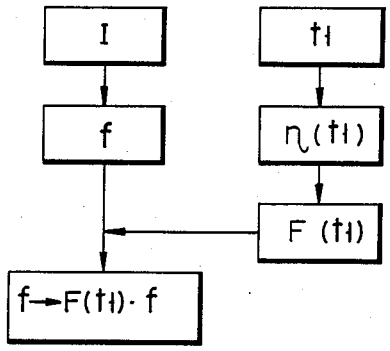

In FIG. 12, when the exciting current value I is set, the penetration heat quantity Q is decided and the operating frequency f to provide the refrigerating capability corresponding to it is determined. However, this operating frequency f represents the case where the refrigerating capability doesn't deteriorate with a time. Since the elapsed time $t_1$ from the start of the operation is known, a degradation factor $\eta(t_1)$ can be known from $P(t_1)/P_0$ which is obtained from FIG. 11. The refrigerator 212 is operated at a frequency $F(t_1)\cdot f$ having a frequency increasing rate $F(t_1)$ to compensate for this amount of deterioration $\eta(t_1)$, thereby compensating for the degradation in refrigerating capability with time. To practically perform this compensation, the characteristic of FIG. 11 is preliminarily memorized in the CPU 232. When a deviation occurs between the measured value of the temperature measuring instrument 234 or the pressure measuring instrument 236 in FIG. 7 and the objective value before the time when the refrigerating capability becomes $P_f$, the frequency set signal a may be output from the CPU 232 to the inverter variable speed control unit 231 so as to compensate for this deviation.

Figure 13:
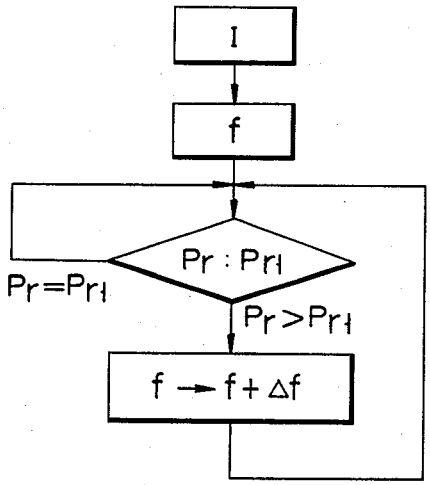

Next, another way of compensating for the degradation in refrigerating capability of the refrigerator 212 with time will be explained with reference to FIG. 13. Namely, when the exciting current value I to the superconducting coil 206 is set, the operating frequency f corresponding to this is determined. In the case where the pressure $P_r$ in the inner chamber 203 is lower than $P_{r1}$ due to the deterioration in the refrigerating capability when the device is operated at a frequency f, the operating frequency is increased by $\Delta f$. Then the device is driven at the operating frequency of $(f+\Delta f)$. The operating frequency is increased until $P_r$ equals $P_{r1}$, thereby compensating for the deterioration in refrigerating capability with time. This compensating function is included in the flow chart of FIG. 10. To practically perform this compensation, the measured value of the temperature measuring instrument or the pressure measuring instrument 236 in FIG. 7 is input to the CPU 232 at every given period of time, and the measured value input and the set value are compared therein. When a deviation occurs, the frequency set signal a may be output from the CPU 232 to the inverter variable speed control unit 231 so as to compensate for this deviation amount.

Figure 14:
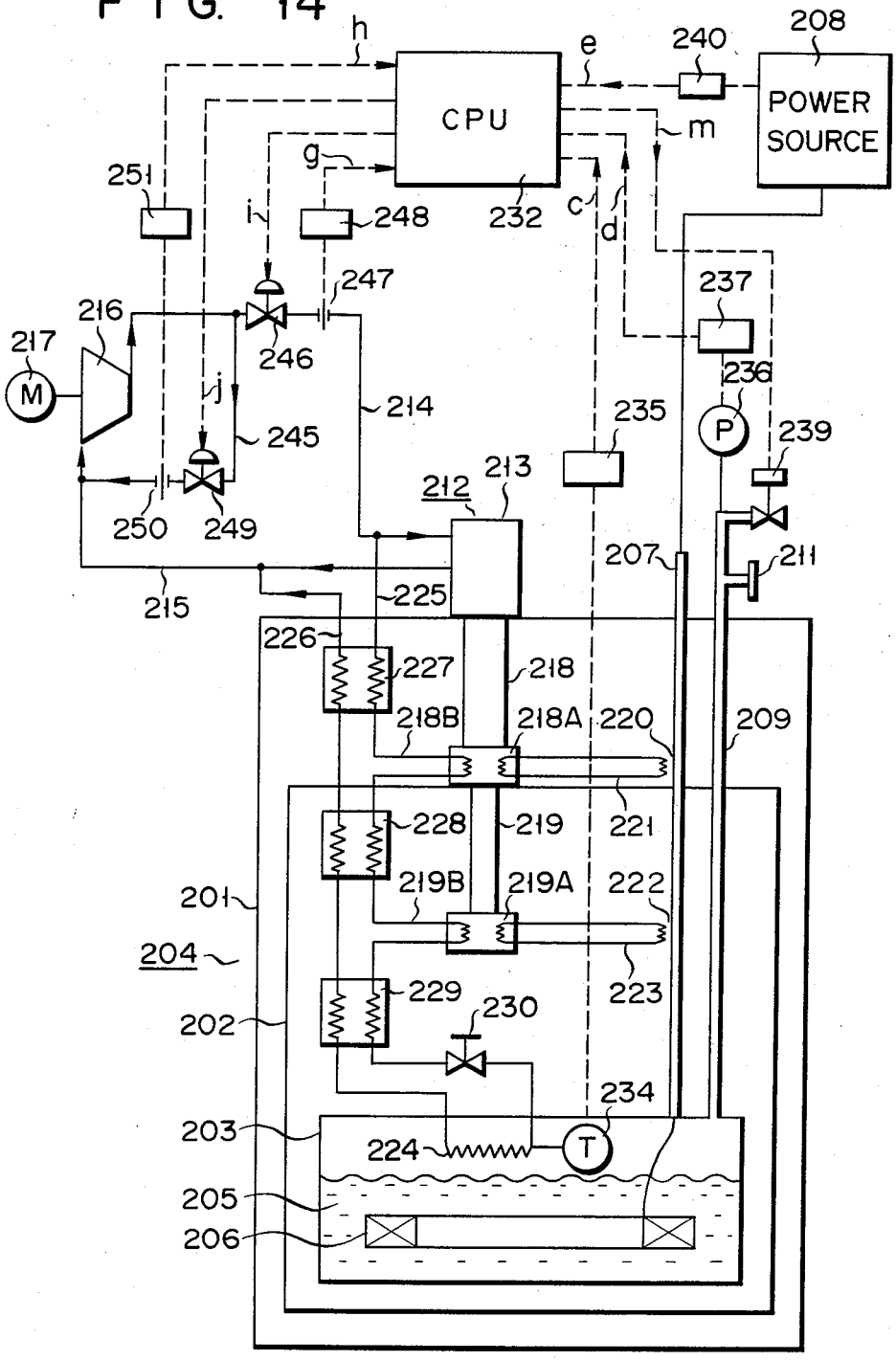
FIGS. 14 and 15 are constitutional diagrams showing other modifications of the second embodiment.

A modified form of the second embodiment of the present invention will then be explained with reference to FIG. 14. In FIG. 14, the same parts and components as those shown in FIG. 7 are designated by the same reference numerals and their descriptions will be omitted. In FIG. 7, the rotating speed of the motor 217 is controlled by use of the inverter variable speed control unit 231; however, in this modification, the main flow rate of cryogen can be controlled in place of that constitution. Namely, a main flow rate adjusting valve 246 and a main flow rate measuring instrument 247 are provided in series in the cryogen inflow piping 214 on the discharge side of the compressor 216. A by-pass piping 245 is connected between the main flow rate adjusting valve 246 and the inflow side of the compressor 216. A by-pass flow rate adjusting valve 249 and a by-pass flow rate measuring instrument 250 are provided in series in this by-pass piping 245. The flow rates measured by the main flow rate measuring instrument 247 and the by-pass flow rate measuring instrument 250 are converted to electric control signals g and h by converters 248 and 251 and are input to the CPU 232.

In addition to the above-mentioned electric control signals g and h, the control signal c based on the temperature of the recondenser 224, control signal d based on the pressure of the bursting piping 209 and control signal e based on the exciting current of the superconducting coil 206 are input to the CPU 232 similarly to FIG. 7. Predetermined arithmetic processings are performed in the CPU 232, so that valve opening command signals i and j are given to the main flow rate adjusting valve 246 and the by-pass flow rate adjusting valve 249; and at the same time the on/off signal m is given to the automatic valve 239.

Even in the modified form of the second embodiment of this invention constituted in this way, the similar effect as in the foregoing second embodiment is obtained. Furthermore, the control range of the refrigerator 212 can be wide since the main flow rate adjusting valve 246 and the by-pass flow rate adjusting valve 249 are respectively provided on the discharge side of the compressor 216 of the cryogen inflow piping 214 and in the by-pass piping 245.

Figure 15:
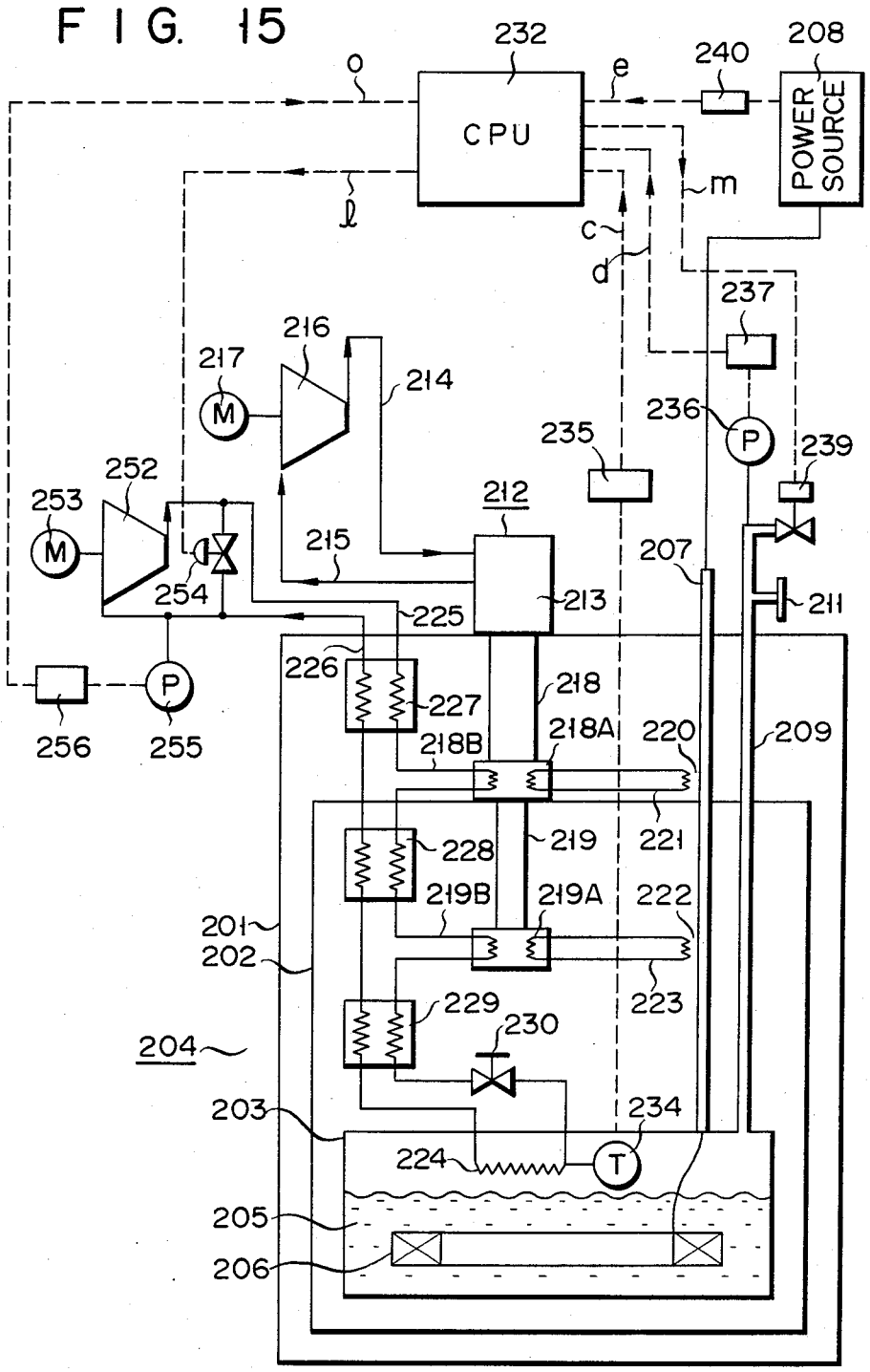

Another modified form of the second embodiment of this invention will now be described with reference to FIG. 15, in which the same parts and components as those shown in FIG. 7 are designated by the same reference numerals and their descriptions will be omitted. Although the rotating speed of the motor 217 has been controlled by the inverter variable speed control unit 231 in FIG. 7, the pressure of the cryogen can be controlled in the J - T piping system in place of that arrangement. Namely, the J - T inflow piping 225 and the J - T return piping 226 are not connected to the cryogen inflow piping 214 and to the cryogen return piping 215, but the discharge and inflow sides of a compressor 252 are connected to the piping 225 and 226. A pressure adjusting valve 254 is provided between the discharge side and the inflow side of the compressor 252. A motor 253 to drive the compressor 252 is connected thereto. On the other hand, a pressure measuring instrument 255 is provided on the inflow side of the compressor 252 of the J - T return piping 226. The pressure on the inflow side is measured by this pressure measuring instrument 255 and the measured value is converted to an electric control signal O by a converter 256. This control signal O is input to the CPU 232. In addition to this signal O, the control signal c based on the temperature of the recondenser 224, control signal d based on the pressure of the bursting piping 209 and control signal e based on the exciting current of the superconducting coil 206 are also input to the CPU 232 similarly to FIG. 7. The predetermined arithmetic processings are performed in the CPU 232, so that a valve opening command signal l is output to the pressure adjusting valve 254, and at the same time the on/off signal m is further given to the automatic valve 239.

Even in this another modification of the second embodiment of the present invention which was constituted in this way, the similar effect as in the foregoing second embodiment is obtained. Further, since the pressure adjusting valve 254 is provided between the J - T inflow piping 225 and the J - T return piping 226, there is an advantage such high reliability is obtained without a decrease in the cryogen pressure in the J - T return piping 226 from a constant value, namely, without becoming negative.

On the other hand, although the rotating speed of the motor 217 to drive the compressor 216 has been controlled by the inverter variable speed control unit 231 in the second embodiment of FIG. 7 mentioned above, the invention is not limited to this. For example, the rotating speed of the motor 217 may be controlled by use of a change gear or the like. Furthermore, the small refrigerator in the foregoing second embodiment has been described in consideration of the Gifford McMahon type or the Solvay type; however, similar actions and effects are obtained even in the case where a Stirling type refrigerator is used.

According to the second embodiment of the present invention and the respective modified forms thereof mentioned above, it is possible to provide a superconducting magnet device which can control the refrigerating capability of the small refrigerator in response to the change in the quantity of penetration heat in association with the change in the value of the exciting current for the superconducting coil, which can select the operating current for the superconducting coil to have a value in a wide range without fear of mixing an impurity into the piping system, which can always control the temperature or pressure of the cryogen to have a constant value, and which can operate reliably operation a long time.

Obviously, the technique for controlling the refrigerating capability of the small refrigerator in accordance with the penetration heat quantity which has been adopted in the second embodiment can be also applied to the first embodiment (especially, to the devices using the two small refrigerators in FIGS. 2 and 3).

What is claimed is:

1. A superconducting magnet device comprising:

a cold insulation vessel which is composed of an inner chamber in which cryogen is sealed, and outer chamber for enclosing said inner chamber and a shield member for heat radiation which is provided between said inner chamber and said outer chamber, said vessel holding a superconducting coil which is enclosed in said inner chamber at a very low temperature;

a power lead for supplying an exciting current to said superconducting coil;

a recondenser for recondensing the evaporated gas of the cryogen in said inner chamber;

small refrigerator means having a plurality of refrigeration stages which are directly and respectively coupled to said power lead and said recondenser; and control means for controlling the refrigerating capability of said small refrigerator means in accordance with the quantity of heat penetrating into said add insulation vessel.

2. A device according to claim 1, wherein the conduction cross-sectional areas and the conduction lengths of said power lead among said refrigeration stages are set such that the quantity of penetration heat becomes minimum.

3. A device according to claim 1, wherein said small refrigerator means is directly attached to said cold insulation vessel.

4. A device according to claim 1, wherein said small refrigerator means includes a refrigeration stage which is directly coupled to said thermal radiation shield member.

5. A device according to claim 1, wherein said small refrigerator means includes first and second small refrigerators each having a plurality of refrigeration stages which are respectively directly coupled to said power lead and said recondenser.

6. A device according to claim 1, wherein said small refrigerator means includes a single small refrigerator having a plurality of refrigeration stages, which is partially directly commonly coupled to said power lead and to said recondenser.

7. A device according to claim 1, wherein said control means has rotating speed control means for controlling the rotating speed of a motor to drive a compressor of said small refrigerator means.

8. A device according to claim 1, wherein said control means has cryogen flow rate control means for controlling the discharge flow rate of the refrigerant from a compressor of said small refrigerator means.

9. A device according to claim 1, wherein said control means has cryogen pressure control means for controlling the pressure of the cryogen in a compressor of said small refrigerator means in a J - T piping system which is connected to said compressor.

10. A device according to claim 1, wherein said control means includes a means for opening and closing an automatic valve for bursting in said inner chamber.

11. A device according to claim 1, wherein said control means includes a means for compensating the deterioration of the refrigerating capability of said small refrigerator means with time.

* * * * *